US005098144A

United States Patent [19]

Marvin

[11] Patent Number: 5,098,144

[45] Date of Patent: Mar. 24, 1992

[54] CUP CARRIER WITH REMOVABLE SIZING RINGS

[75] Inventor: Claire C. Marvin, Park Ridge, Ill.

[73] Assignee: Scypher Corporation, Naperville, Ill.

[21] Appl. No.: 582,127

[22] Filed: Sep. 12, 1990

Related U.S. Application Data

[63] Continuation of Ser. No. 302,447, Jan. 27, 1989, abandoned.

[51] Int. Cl.[5] ..... B65D 71/00

[52] U.S. Cl. ..... 294/87.2; 294/159; 206/150; 206/197

[58] Field of Search ..... 294/87.2, 31.2, 146, 294/149, 159, 165; 206/145, 150, 151, 158, 192, 197, 427, 432, 601, 606, 608, 611

[56] References Cited

U.S. PATENT DOCUMENTS

| | | | |
|---|---|---|---|
| 2,466,636 | 4/1949 | Bruckner et al. | 294/146 |
| 2,998,174 | 8/1961 | Weder et al. | 224/48 |
| 3,268,070 | 8/1966 | Cunningham | 206/65 |
| 3,341,245 | 9/1967 | Wolford | 294/87.2 |
| 3,640,380 | 2/1972 | Huffman | 294/146 X |
| 3,711,145 | 1/1973 | Rapata | 294/87.2 |
| 4,273,273 | 6/1981 | Zenri | 294/87.2 |
| 4,548,317 | 10/1985 | Weaver | 206/162 |
| 4,557,375 | 12/1985 | Weaver et al. | 206/151 |
| 4,793,647 | 12/1988 | Marvin | 294/87.2 |
| 4,799,723 | 1/1989 | Mahaffy | 294/87.2 |
| 4,850,479 | 7/1989 | Bird | 294/87.2 X |

FOREIGN PATENT DOCUMENTS 0142360 5/1985 European Pat. Off. .

*Primary Examiner*—Margaret A. Focarino
*Assistant Examiner*—Dean J. Kramer
*Attorney, Agent, or Firm*—Baker & McKenzie

[57] ABSTRACT

A drink cup carrier cut from a single sheet of flexible plastic includes a plurality of circular cup engaging portions each suspended by support straps from a bail. Each of the circular cup engaging portions includes at least one sizing ring held therein by a perforated circular cut and removable therefrom for accepting drink cups of different sizes.

17 Claims, 1 Drawing Sheet

CUP CARRIER WITH REMOVABLE SIZING RINGS

This is a continuation of application Ser. No. 302,447, filed Jan. 27, 1989, now abandoned.

BACKGROUND OF THE INVENTION

1. Field of the Invention

The present invention relates generally to a carrier for carrying up to a predetermined number of drink cups, and more particularly to a cup carrier which is adaptable to carrying drink cups of different sizes.

2. Description of the Related Art

Food services facilities generally provide cups of paper, plastic, styrofoam or cardboard for carryout drink service. When more than one drink is purchased by a customer, the difficulty of carrying several drink cups from the food service facility becomes apparent, particularly when the cups are of different sizes. Customers often attempt to balance or hold the drinks cups individually, frequently resulting in spills. On occasion, the drink cups are placed in a paper bag for carryout; however, paper bags lack stability to maintain the drink cups upright and spills occur within the paper bag, the paper weakens and the drink cups fall through the bottom of the paper bag.

Multiple drink orders may also be served with a cardboard tray for holding the drink cups. The drink cups rest on a bottom floor of the tray, and the sides of the cups near the bottom are engaged by a second portion of the tray. Such trays are generally insufficiently strong to adequately support drink cups full of liquids. Also, by engaging the drink cups at points near the bottom of the cup, instability during carrying results, often leading to tipping of cups and spilling of the contents. When smaller cups are carried in such trays, they are held less tightly than larger cups due to their smaller bottom diameters.

A related cup caddy is disclosed in U.S. Pat. No. 4,793,647, issued Dec. 27, 1988. The cup caddy has cup carrier portions with circular openings that engage the side walls of the cup by sliding up the sides until the cup engaging portion reaches a point that diameter of the cup wall matches the diameter of the opening. Although cups of somewhat different sizes can be carried therein, more widely ranging cup sizes cannot be carried effectively in one size cup caddy.

SUMMARY OF THE INVENTION

An object of the present invention is to provide a drink cup carrier which is adaptable to carry drink cups of many different and widely ranging sizes. This and other objects of the invention are achieved in a cup caddy or cup carrier for drink cups of many different sizes which supports each of the cups individually in an upright position to reduce the chance of spilling the contents of the cups. Up to a predetermined number of drink cups, including cups of mutually different sizes, may be carried in a single carrier, the carrier being particularly adapted for carrying less than a predetermined number of drink cups while resisting the tendency of the cups to tip or otherwise become unstable.

The cup carrier of the present invention is formed from a single sheet of material and includes a plurality of cup engaging portions, each for encircling a cup in an engaging relationship. The cup engaging portions each include one or more removable concentric sizing rings by which the cup engaging portions are adapted for engagement with cups of a wide range of different sizes. For smaller cups, the sizing rings are left in place, while for larger cups they are removed to accommodate the larger diameters thereof. The number and size of the sizing rings will depend on the range and number of sizes of cups to be carried.

In a preferred embodiment, support webs or straps extend generally from opposite sides of the cup engaging portions for independently supporting each of the cup engaging portions in a level position when a cup is held therein. A bail is included spanning the cup engaging portions and is affixed to each of the support webs or straps. It is also possible to include a handle generally at the center of the bail by which the cup carrier of the present invention is held and suspended.

Thus, there is provided a cup carrier or cup caddy for drink cups and the like by which an individual can carry one, two, three, four or more drink cups of different sizes and even of mutually different sizes, each in a level position. The present cup carrier is strong, light, and easy to manufacture from a single sheet of material, such as plastic material. In a preferred embodiment, it is made from a photo-degradable plastic so that it does not become a litter problem.

DESCRIPTION OF THE PREFERRED EMBODIMENTS

Figure 1:
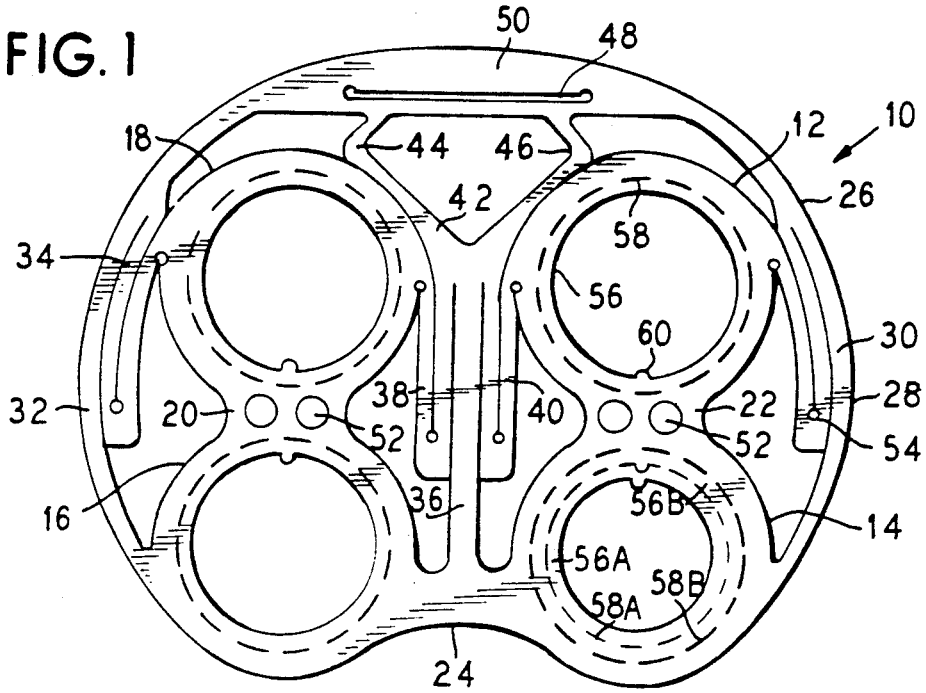
FIG. 1 is a plan view of a cup carrier which has been cut from a single sheet of plastic, includes sizing rings according to the principals of the present invention.
Figure 2:
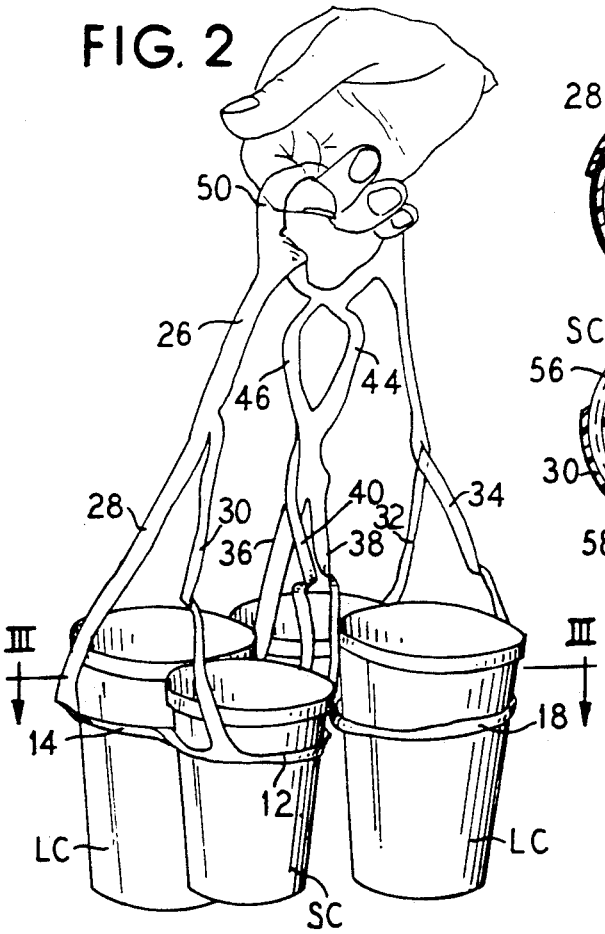
FIG. 2 is a perspective view of the cup carrier of Figure shown holding four drink cups of different sizes.

In FIG. 1 is shown a cup carrier 10 of a preferred embodiment including four cup engaging portions 12, 14, 16 and 18. The cup engaging portions 12 through 18 are joined to one another by linking webs 20, 22 and 24. A bail 26 is provided which is linked at a first end to the cup engaging portion 14 by a linking strap 28. This same end of the bail 26 is connected to one side of the cup engaging portion 12 by a linking strap 30, which is doubled back on itself when in the flat position and which extends, as shown in FIG. 2, when supporting a cup. The opposite end of the bail 26 contains a like arrangement of a linking strap 32 connected to one side of the cup engaging portion 16 and a doubled back linking strap 34 connected to one side of the cup engaging portion 18. By way of the supporting straps 28 through 34, the bail 26 supports the cup engaging portions 12 through 18 at four outside support points.

In order to provide level support of the cup engaging portions 12 through 18, a central portion of the bail 26 including means for supporting the inside edges of the cup engaging portions. This is provided by a center support strap 36 extending from the web 24 toward a mid point of the bail 26, as well as first and second folded back center support straps 38 and 40. The main center strap 36 and the folded center straps 38 and 40 extend to a lower end of an expansion element 42 formed by first and second arms 44 and 46. The arms 44 and 46 each include an elbow extending in opposite directions so that longitudinal tension on the expansion element 42 causes the arms 44 and 46 to be drawn inward, thereby lengthening the expansion element 41. Other shapes and arrangements of expansion elements are, of course, possible. The arms 44 and 46 are connected at spaced locations along the central portion of the bail 26. Opposite the expansion element 42 is provided a slot 48 which forms a handle 50 in an upper portion of the bail 26. The handle 50 also provides some longitudinal expansion, as can be seen in FIG. 2.

In one embodiment, the linking webs 20 and 22 include punched out openings 52 which increase the flexibility of the linking webs 20 and 22 as well as reducing weight and material in the device. The corners at each folded back portion includes a circular stress relieving punch out 54 to avoid tearing.

The present invention is particularly characterized by removable sizing rings 56 in each of the cup engaging portions 12 through 18. The sizing rings 56 are formed by increasing the width of the cup engaging portions 12 through 18 and by forming one or more perforated circular cuts 58 concentrically about the body of the cup engaging portion. In this way, a smaller size cup can be inserted directly into the cup engaging portion as shown in FIG. 1 yet the device can still be used to hold larger cups by removing the sizing ring 56 from the corresponding cup engaging portion. Although is possible to make provide several sizing rings in each of the cup engaging portions 12 through 18, a preferred embodiment includes only a single sizing ring 56 as shown in the cup engaging portions 12, 16 and 18.

To illustrate the possibility of providing more than one sizing ring in a cup engaging portion, the cup engaging portion 14 includes two sizing rings 56A and 56B arranged concentrically in the portion 14. When a very small cup, relative to the sizes of the other cups, is to be held, it is inserted directly into the central opening of the sizing ring 56A. When it is desired to hold a medium size cup, the first, inner sizing ring 56A is removed, leaving the second sizing ring 56B in place. This is accomplished by tearing along the perforation 58A. Both sizing rings 56A and 56B are removed when a large cup is to be held in the cup engaging portion 14 by tearing on the perforation 58B. To ensure that only the inner ring 56A is removed when desired, the perforations 58B are more resistant to tearing than the perforations 58A, such as by being less closely spaced. Of course, the same number of sizing rings is provided in each cup engaging portion of a single cup carrier.

The preferred embodiment, however, has only one sizing ring 56 since may still be possible to inadvertently remove the wrong number of rings. By providing only one sizing ring 56, the cup engaging portions may be adjusted to two different diameters. Due to the tapered sides of most drink cups, these two sizes fit most commonly used sizes of drink cups currently available. It is contemplated to match the diameters of the sizing rings to the cups with which the device will be used.

To assist in removal of the sizing rings 56, a finger tab 60 is provided for grasping to initiate tearing along the perforated cut line 58. In the embodiments having two or more sizing rings 56A and 56B, the finger tabs 60 are provided on each ring, aligned as shown in FIG. 1.

In FIG. 2 is shown the embodiment of the cup caddy 10 holding four cups in a suspended engagement by lifting on the handle 50. As the handle is lifted, the folded straps 30, 34, 38 and 40 straighten out to support the cup engaging portions 12 and 18 from the bail 26. The cup engaging portions 14 and 16 are supported by the straps 28, 32 and 36. To insure that the center sides of the cups are supported in a position level with the outsides, the lengthening element 42 provides expansion of the center support straps by the flexing of the arms 44 and 46 toward one another and as well as the sagging of the central portion of the bail 26 below the handle 50.

As can be seen in FIG. 2, both small cups SC and large cups LC may be held together in the cup engaging portions 12 through 18 of a single embodiment. The small cup SC is inserted directly into the cup engaging portion 12 while the sizing ring 56 remains in place so that the sides of the small cup SC are pressed against the inner circumference of the sizing ring 56. To mount the large cup LC in the cup engaging portions, the sizing ring 56 for the corresponding cup engaging portion is removed by tearing along the perforated line 58 and the large cup LC inserted thereinto so that the side walls of the large cup LC are pressed against the inner circumference formed by the perforated line 58. Depending upon the size of the drink cup, the taper of the walls of the drink cup, and the diameters of the cup engaging portions and the sizing rings, cups in a very wide range of sizes may be held in a single embodiment of the present invention. All small cups may be held, all large cups may be held, or, as can be seen in FIG. 2, cups of mixed sizes can even be held in one cup carrier unit.

Figure 3:
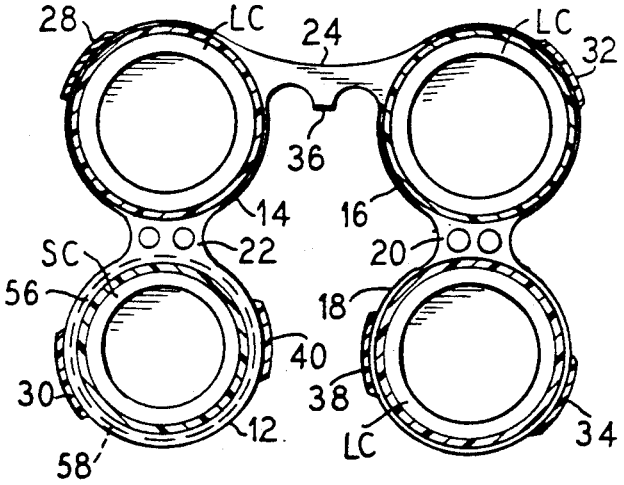
FIG. 3 is a cross section along line III—III of FIG. 2 showing the relationship of the cups held in suspension in the cup carrier.

Referring to FIG. 3, a view looking into the cups LC and SC shows that each of the cups is supported independently of one another irrespective of their size and irrespective of whether the sizing rings 56 are in place or have been removed. As a result, the different weights of larger and smaller size cups in the device will not affect the ability to carry the cups in a level condition without tipping and spilling.

Figure 4:
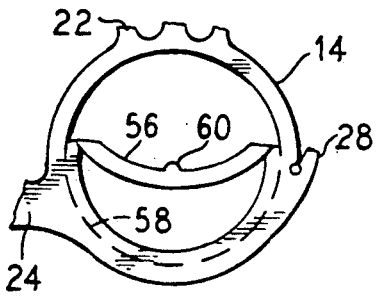
FIG. 4 is a fragmentary view of the single cup engaging portion of the cup carrier of FIG. 1 showing removal of a sizing ring.

In FIG. 4 is shown the cup engaging portion 14 in which the sizing ring 56 is being removed by tearing along the perforated line 58 so that the diameter of the cup engaging portion is increased for carrying larger cups. As described above, it is of course possible to provide a plurality of concentric sizing rings, one or more of which may be removed at a time for adapting to different sized cups.

Although other modifications and changes may be suggested by those skilled in the art, it is the intention of the inventors to embody within the patent warranted hereon all changes and modifications as reasonably and properly come within the scope of his contribution to the art.

I claim:

1. A cup carrier for carrying up to a predetermined number of cups, comprising:

a predetermined number of cup engaging portions each having a generally circular configuration for encircling a cup in an engaging relationship;

a handle connected to said cup engaging portions for supporting said predetermined number of cup engaging portions in suspension, said handle being in the form of a bail positioned above said cup engaging portions when suspending said cup engaging portions; and a sizing ring in at least one of said predetermined number of cup engaging portions, said sizing ring having a first inner diameter of a size and shape to accept a cup of a first smaller size, said sizing ring being selectively completely removable by tear away portions from said cup engaging portion so that said cup engaging portion is of a size and shape to accept a cup of a second larger size with said sizing ring removed.

2. A cup carrier as claimed in claim 1, wherein said cup carrier is cut from a sheet of flat of flexible material.

3. A cup carrier as claimed in claim 1, wherein said sizing ring includes a finger engaging tab.

4. A cup carrier as claimed in claim 1, wherein said sizing ring is held in said cup engaging portion by a perforation cut, and is removable by tearing of said perforation cut.

5. A cup carrier as claimed in claim 1, wherein a sizing ring is provided in each of said engaging portions.

6. A cup carrier for carrying up to a predetermined number of cups, comprising:

a predetermined number of cup engaging portions each having a generally circular configuration for encircling a cup in an engaging relationship;

means for supporting said predetermined number of cup engaging portions in suspension;

a sizing ring in at least one of said predetermined number of cup engaging portions, said sizing ring having a first inner diameter, said sizing ring being selectively removable from said cup engaging portion to provide a larger diameter in said cup engaging portion, said sizing ring being a first sizing ring; and at least a second sizing concentrically mounted in said first sizing ring and selectively removable therefrom.

7. A cup carrier as claimed in claim 6, wherein a first perforation cut holds said first sizing ring in said cup engaging portion, and a second perforation cut holds said second sizing ring in said first sizing ring.

8. A cup carrier as claimed in claim 7, wherein said first perforation cut is more tear resistant than said second perforation cut.

9. A carrier for at least one cup or the like, comprising:

a carrier body of a thin flexible sheet of plastic material;

a handle on said carrier body by which said carrier may be held and carried; and a sizing ring removably attached to said carrier body only by a plurality of frangible portions, said sizing ring defining a circular interior opening of a size to receive a cup or the like of a first smaller size to be carried in said carrier, said sizing ring remaining in position in said carrier body when a first smaller size cup is received in said circular interior opening, said sizing ring being completely removable from said carrier to leave a larger circular interior opening in said carrier body of a size to receive a cup or the like of a second larger size for being carried in said carrier.

10. A carrier as claimed in claim 9, wherein said carrier is adapted for carrying drink cups.

11. A carrier as claimed in claim 9, wherein said carrier body is of a shape to carry a plurality of cups or the like and wherein said sizing ring is a first sizing ring, and further comprising:

a plurality of further sizing rings in said carrier body, said, said further sizing rings being for carrying further of said plurality of cups.

12. A carrier as claimed in claim 9, wherein said sizing ring is removably attached to said carrier body by a series of tear sections along a perforation line.

13. A carrier as claimed in claim 12, wherein said sizing ring is a continuous ring of said plastic material.

14. A carrier as claimed in claim 12, wherein said perforation line is a series of slits lying generally in a circle.

15. A carrier for a plurality of cups or the like, comprising:

a carrier body formed from a flexible web of material, said carrier body defining a plurality of circular openings for receiving up to a like number of cups or the like; and a plurality of sizing rings each having a circular inner edge and a circular outer edge, said sizing rings being removably mounted in each of said circular openings in said carrier body only by frangible portions, said circular outer edge of said sizing rings being of the same size as said circular openings in said carrier body in which respective ones of said sizing rings are mounted, said circular inner edges of said sizing rings adapted for receiving cups or the like of a smaller size than said circular openings of said carrier body and said sizing rings each being individually completely removable from said carrier body to free said circular openings for receiving cups or the like of a larger size.

16. A cup carrier for carrying up to a predetermined number of cups, comprising:

a predetermined number of cup engaging portions each having a generally circular inner edge for encircling a cup in an engaging relationship;

means for supporting said predetermined number of cup engaging portions in suspension; and a sizing ring in at least one of said predetermined number of cup engaging portions, said sizing ring having a generally circular inner edge of a size to accept a cup of a first smaller size, said sizing ring being selectively completely removable from said cup carrier so that said circular inner edge of said at least one cup engaging portion is capable of accepting a cup of a second larger size.

17. A cup carrier for carrying up to a predetermined number of cups, comprising:

a predetermined number of cup engaging portions each having a generally circular configuration for encircling a cup in an engaging relationship;

a handle connected to said cup engaging portions for supporting said predetermined number of cup engaging portions in suspension, said handle being in the form of a bail positioned above said cup engaging portions when suspending said cup engaging portions; and a sizing ring held adjacent to at least one of said cup engaging portions along a major portion of the periphery of said sizing ring, said sizing ring defining a first inner diameter of a size and shape to accept a cup of a first smaller size in supporting engagement, the outer circumference of said sizing ring being held substantially adjacent to the inner circumference of said cup engaging portion by said frangible support tabs distributed in a pattern extending throughout the entire interface between said outer circumference of said sizing ring and said inner circumference of said cup engaging portion, such that forces sufficient to support a cup in said sizing ring are transferred to said cup engaging support tabs through said frangible portions, said sizing ring being at least partially removable from said at least one cup engaging portion along said frangible support tabs so that at least one cup engaging portion defines a second inner diameter of a size and shape to accept a cup of a second larger size in supporting engagement, said sizing ring being out of supporting engagement with a cup when at least partially removed from said at least one cup engaging portion.

* * * * *